United States Patent [19]

Torita et al.

[11] Patent Number: 4,875,607

[45] Date of Patent: Oct. 24, 1989

[54] AUTOMATIC DETERGENT DISPENSER APPARATUS HAVING SYNCHRONOUS MOTOR DRIVE

[75] Inventors: Fumio Torita, Nagoya; Naotaka Ikeda, Yokohama; Kimihiko Nakamura, Seto; Katsuharu Matsuo, Nishikasugai; Tomio Hotta, Kuwana; Yoshiyuki Makino, Nagoya, all of Japan

[73] Assignee: Kabushiki Kaisha Toshiba, Kawasaki, Japan

[21] Appl. No.: 127,960

[22] Filed: Dec. 2, 1987

[30] Foreign Application Priority Data

Mar. 14, 1987 [JP] Japan ..... 62-59694

[51] Int. Cl.[4] ..... B67D 5/06; G01F 11/00

[52] U.S. Cl. ..... 222/643; 222/651; 222/236; 222/231; 68/17 R; 134/93

[58] Field of Search ..... 222/651, 642, 643, 14, 222/15, 16, 17, 20, 36, 37, 231, 236; 68/17 R; 134/93; 377/39; 318/700, 705; 310/68, 688, 162

[56] References Cited

U.S. PATENT DOCUMENTS

| | | | |
|---|---|---|---|
| 2,159,559 | 5/1939 | Lawyer . | |
| 3,132,769 | 5/1964 | Zehrbach | 222/651 |
| 3,137,818 | 6/1964 | Clapper | 377/39 X |
| 3,223,108 | 12/1965 | Martz | 68/17 R |
| 3,301,022 | 1/1967 | Low | 68/17 R |
| 3,743,140 | 7/1973 | Saverbrey | 222/63 |
| 3,826,113 | 7/1974 | Noraas et al. | 222/643 X |
| 4,009,598 | 3/1977 | Bernard et al. . | |
| 4,015,749 | 4/1977 | Arzberger et al. | 222/129.4 X |
| 4,162,028 | 6/1979 | Reichenberger | 222/129.4 |
| 4,194,651 | 3/1980 | Martin et al. | 222/129.4 X |
| 4,202,387 | 5/1980 | Upton | 222/54 X |
| 4,207,995 | 6/1980 | Neely | 222/236 X |
| 4,357,861 | 11/1982 | DiGirolamo | 222/129.4 X |
| 4,503,575 | 3/1985 | Knoop et al. . | |
| 4,515,292 | 5/1985 | Koos | 222/DIG. 1 X |
| 4,582,097 | 4/1986 | Izzi et al. | 222/643 X |
| 4,691,850 | 9/1987 | Kirschmann et al. . | |

FOREIGN PATENT DOCUMENTS

| | | | |
|---|---|---|---|
| 0065209 | 5/1982 | European Pat. Off. . | |
| 3528128 | 2/1987 | Fed. Rep. of Germany | 68/17 R |
| 4218769 | 9/1942 | Japan . | |
| 54-43827 | 12/1979 | Japan . | |
| 1206490 | 9/1986 | Japan | 68/17 R |

*Primary Examiner*—Kevin P. Shaver
*Assistant Examiner*—Stephen B. Parker
*Attorney, Agent, or Firm*—Cushman, Darby & Cushman

[57] ABSTRACT

A cleanser feeding mechanism has a cleanser housing portion, a cleanser feeding member for feeding a cleanser housed in the cleanser housing portion, and a synchronous motor for applying a drive force to the cleanser feeding member, and feeds and amount of cleanser corresponding to the number of revolutions of the synchronous motor. A cleanser feeding amount-setting unit sets an amount of cleanser to be fed from the cleanser feeding mechanism. A driving unit applies an AC source voltage of an AC power source to the synchronous motor. A counter counts the number of cycles of the AC source voltage from a timing at which the AC source voltage is applied to the synchronous motor. A reference cycle number-setting unit sets a total cycle number of the AC source voltage which corresponds to a cleanser amount set by the cleanser feeding amount-setting unit. A motor controller compares a count output from the counter with a total cycle number from the reference cycle number-setting unit and stops application of the AC source voltage to the synchronous motor when the count output and the total cycle number coincide with each other.

8 Claims, 7 Drawing Sheets

| | WATER LEVEL / AMOUNT OF CLEANSER | HIGH | MEDIUM | LOW | LOWER |
|---|---|---|---|---|---|
| 60 HZ | MUCH | 72" | 65" | 58" | 50" |
| | STANDARD | 60" | 54" | 48" | 42" |
| | RARE | 48" | 43" | 38" | 33" |

| | WATER LEVEL / AMOUNT OF CLEANSER | HIGH | MEDIUM | LOW | LOWER |
|---|---|---|---|---|---|
| 50 HZ | MUCH | 86" | 78" | 69" | 60" |
| | STANDARD | 72" | 65" | 58" | 50" |
| | RARE | 58" | 52" | 46" | 40" |

F I G. 7

| WATER LEVEL / AMOUNT OF CLEANSER | HIGH | MEDIUM | LOW | LOWER |
|---|---|---|---|---|
| MUCH | 4300 | 3900 | 3450 | 3000 |
| STANDARD | 3600 | 3250 | 2900 | 2500 |
| RARE | 2900 | 2600 | 2300 | 2000 |

F I G. 9

AUTOMATIC DETERGENT DISPENSER APPARATUS HAVING SYNCHRONOUS MOTOR DRIVE

BACKGROUND OF THE INVENTION

This invention generally relates to an automatic detergent dispenser apparatus and, more particularly, to an automatic detergent dispenser apparatus for a washing machine and the like, for automatically dispensing a detergent to a washing tub.

A conventional automatic detergent dispenser apparatus for a washing machine and the like is disclosed in Japanese Patent Disclosure No. 54-43827. In this apparatus, cleanser is fed from a hopper into a washing tub through a valve which is manually operated. However, since a feeding amount of a cleanser is determined in accordance with a user's experience, the cleanser cannot always fed in an amount appropriate for the amount of water in the tub.

Therefore, in order to feed a proper amount of cleanser an induction motor may be used as a power source of a cleanser feeding mechanism, and a driving time of the motor is controlled. However, if the driving time of the motor is conditionally set by a timer, the speed at which the motor rotates for the driving time when driven by an AC source voltage of 60 Hz differs from the speed at which the motor rotates when driven by an AC source voltage of 50 Hz. As a result, when the cleanser feeding mechanism having the induction motor is used, a cleanser feeding amount largely varies due to a difference in the source voltage frequencies. To eliminate this problem, the induction motor may be replaced with a DC motor. However, since the speed of rotation of the DC motor largely varies due to a voltage variation, it is difficult to eliminate a variation in the cleanser feeding amount.

As described above, when an induction motor or a DC motor is used as a power source, and the cleanser feeding amount is controlled by changing the driving time of the motor, the amount of the cleanser fed largely varies due to a difference in frequencies of the AC source voltages or due to the voltage variation.

SUMMARY OF THE INVENTION

It is, therefore, an object of the present invention to provide a new and improved automatic detergent dispenser having a synchronous motor, in which the synchronous motor is used as a power source to automatically feed cleanser and a large variation does not occur in the amount of the cleanser fed in spite of a difference in frequencies of AC source voltages.

According to the present invention, there is provided an automatic detergent dispenser apparatus comprising:

- cleanser feeding means, having a cleanser housing portion, a cleanser feeding member for feeding a cleanser housed in the cleanser housing portion, and a synchronous motor for driving the cleanser feeding member, thereby to feed an amount of cleanser corresponding to the number of revolutions of the synchronous motor;
- cleanser feeding amount-setting means for setting an amount of cleanser to be fed from the cleanser feeding means;
- driving means for applying an AC source voltage of an AC power source to the synchronous motor;
- counting means for counting the cycles of the AC source voltage from a timing at which the AC source voltage is applied to the synchronous motor;
- reference cycle number-setting means for setting a total cycle number of the AC source voltage which corresponds to an amount of cleanser set by the cleanser feeding amount set means; and
- motor control means for comparing a count output from the counting means with the total cycle number output from the reference cycle number-setting means and stopping application of the AC source voltage to the synchronous motor when the count and the total cycle number coincide with each other.

In summary, an automatic detergent dispenser apparatus of the present invention is characterized in that a synchronous motor driven by an AC source voltage is used as a power source, a cleanser feeding mechanism feeds an amount of cleanser corresponding to the number of revolutions of the synchronous motor, counting means is provided to count the cycles of the AC source voltage from a timing at which the synchronous motor is driven, and motor control means stops driving of the synchronous motor when the counting means counts the set number of cycles.

In this case, the total number of revolutions of the synchronous motor within the driving time is unconditionally determined in accordance with the total number of the cycles of the AC source voltage within the driving time.

The counting means counts the number of the cycles of the AC source voltage from a timing at which the synchronous motor is driven. When the count reaches a set value, the motor control means stops the driving of the synchronous motor.

Therefore, even if the frequency of the AC source voltage is changed, the total number of revolutions of the synchronous motor remains substantially constant, so that a large variation does not occur in the amount of the cleanser fed.

BRIEF DESCRIPTION OF THE DRAWINGS

These and other objects and features of the present invention can be understood from the following description, by reference to the accompanying drawings, in which:

FIGS. 1 to 8 show an embodiment of the present invention in which,

FIG. 1 is an enlarged longitudinal sectional front view of a cleanser feeding mechanism, FIG. 2 is an enlarged longitudinal sectional side view thereof, FIG. 3 is a perspective view of an upper portion of a washing machine, FIG. 4 is a block diagram concerning control of the washing machine, FIGS. 5A to 5C are views of waveforms of respective portions, FIGS. 6 and 7 are tables of driving times of a synchronous motor obtained by frequencies of AC source voltages of 60 Hz and 50 Hz, respectively, and FIG. 8 is a flow chart; and FIGS. 9 and 10 are a table and a flow chart, respectively, of the total number of cycles supplied to a synchronous motor according to another embodiment of the present invention.

DETAILED DESCRIPTION OF THE PREFERRED EMBODIMENTS

An embodiment of the present invention, or an automatic detergent dispenser apparatus for a washing machine, will be described with reference to FIGS. 1 to 8.

Figure 3:
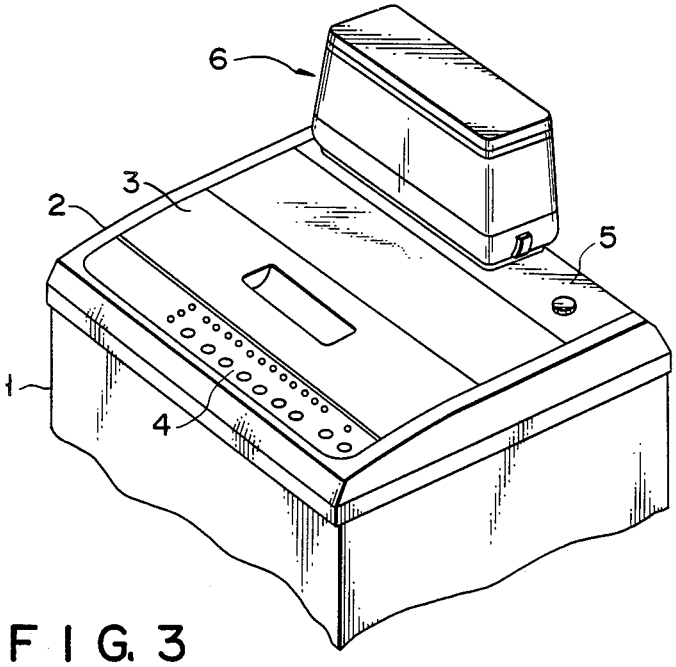

In FIG. 3, reference numeral 1 denotes a casing of a washing machine which can wash clothes and spin-dry them. A known rotary tub (not shown) which is used for both washing and spin-drying clothes is provided in casing 1. Cover 3 for opening/closing a washing port (not shown) is provided on upper cover 2 mounted on an upper surface of casing 1. Reference numeral 4 denotes an operation panel provided on a front portion of upper cover 2. Panel 4 includes a start switch for starting a washing operation, a water level-setting switch for setting a level of water in the rotary tub to "high", "medium", "low", or "lower" level, a cleanser concentration-setting switch for selectively setting a cleanser feeding amount so as to change a cleanser concentration during a wash cycle in accordance with, for example, a degree of dirt of washings, "much", "standard", or "rare". Reference numeral 5 denotes a rear panel provided on a rear portion of upper cover 2. Cleanser feeding mechanism 6 is provided on panel 5.

Figure 1:
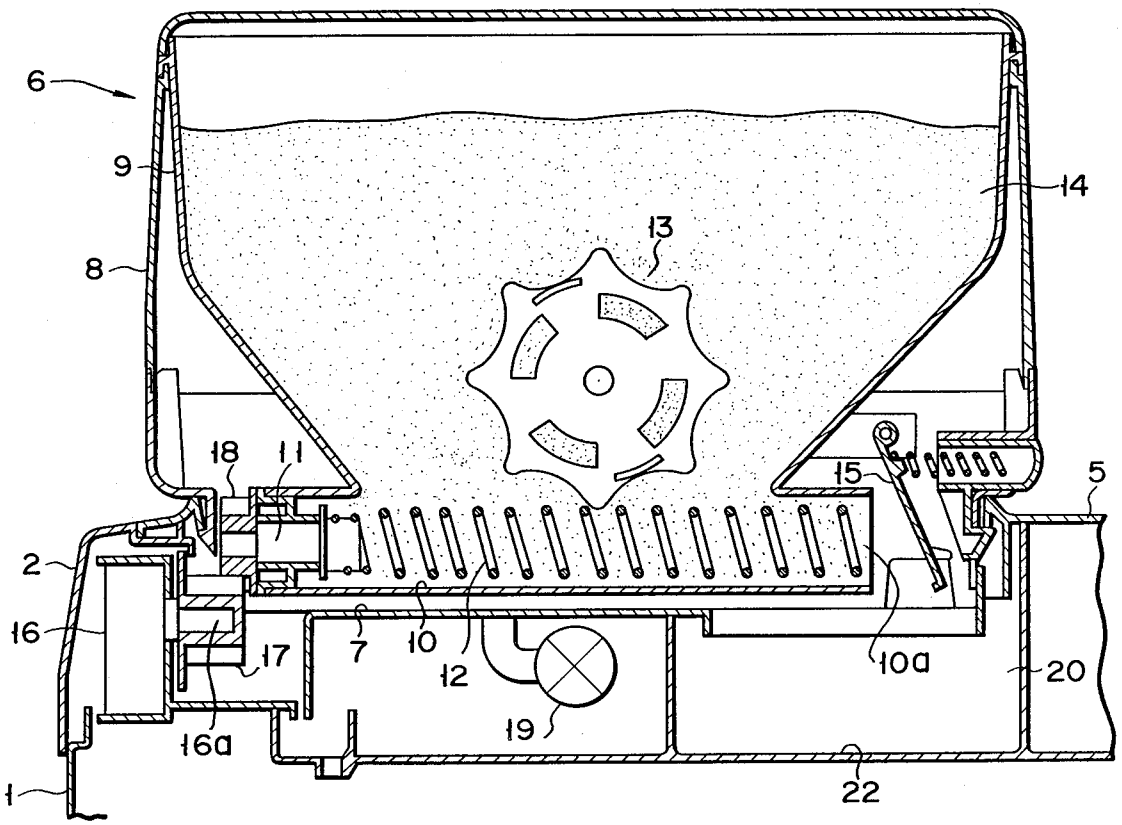
Figure 2:
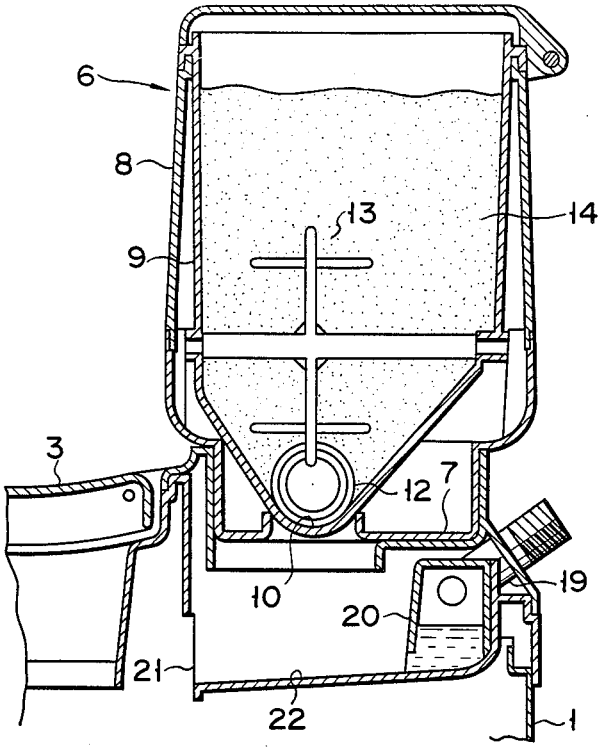

As is shown in FIGS. 1 and 2, recess 7 is formed in rear panel 5, and mechanism 6 is disposed on recess 7. Mechanism 6 comprises outer case 8 and hopper 9, both made of a transparent plastic material. Hopper 9 is provided with case 8. Transverse cylindrical cleanser feeding portion 10 is formed in the lowermost portion of hopper 9. Transmission shaft 11 is rotatably supported at a left end (in FIG. 1) of portion 10. One end of cleanser feeding member 12 consisting of, e.g., a coil and located in portion 10 is connected to shaft 11. Reference numeral 13 denotes an agitator which is driven upon rotation of member 12 to agitate cleanser 14, and numeral 15 designates a small cover for normally closing outlet 10*a* of portion 10 and opening outlet 10*a* when cleanser 14 is to be fed. Synchronous motor 16 for driving member 12 is mounted, at its left end (in FIG. 1), outside recess 7 of rear panel 5. Rotating shaft 16*a* of motor 16 is projecting into recess 7. Driving gear 17 mounted on shaft 16*a* meshes with driven gear 18 mounted on transmission shaft 11. Therefore, when an AC source voltage is applied to motor 16, member 12 is rotated by gears 17 and 18, and cleanser 14 is fed from hopper 9 through outlet 10*a*. In this case, a cleanser feeding amount is determined to correspond to the number of revolutions of member 12 and hence that of motor 16. Water supply unit 20, and water supply port 21 for supplying water from unit 20 to the rotary tub (not shown) are provided in recess 7. Water supply valve 19 is connected to unit 20. A water path extends from unit 20 to port 21 and serves as cleanser receiving portion 22 for receiving a cleanser fed from outlet 10*a* of cleanser feeding portion 10.

Figure 4:
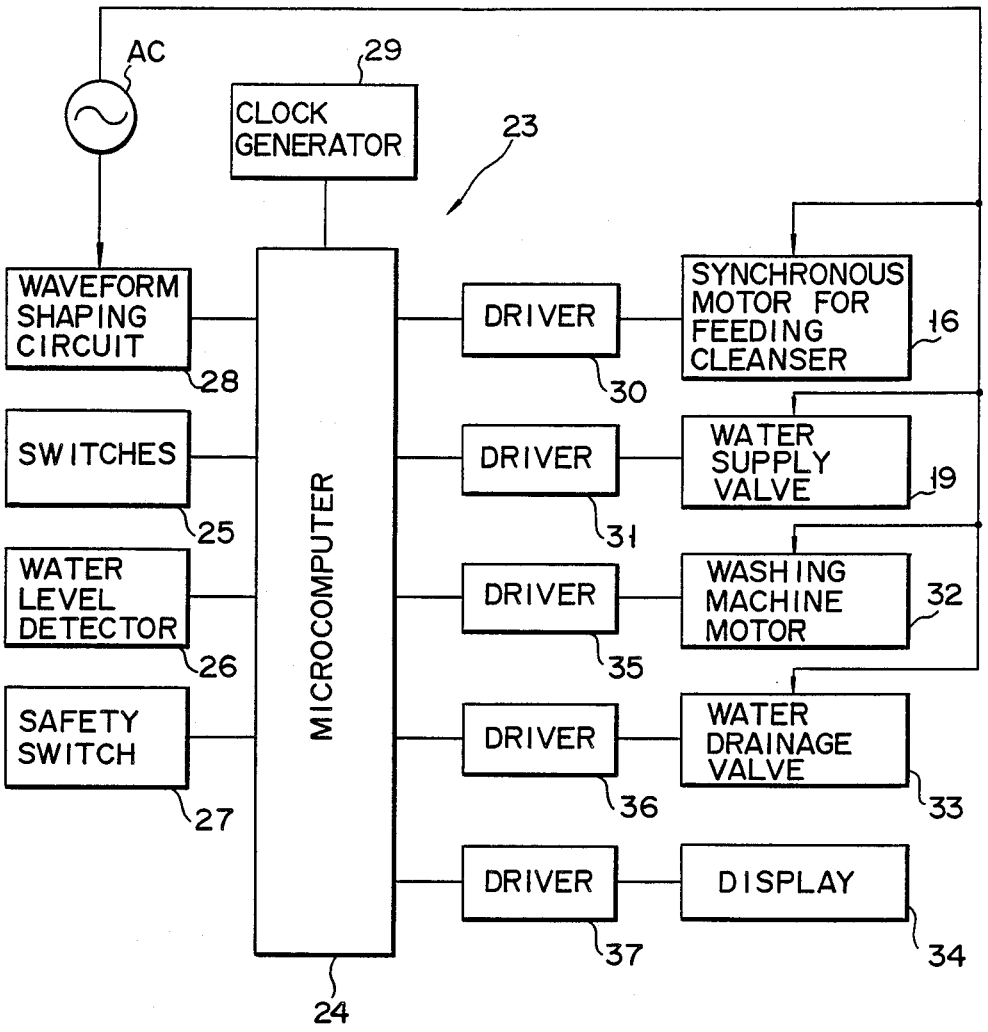

In FIG. 4, reference numeral 23 denotes an operation controller comprising microcomputer 24. Microcomputer 24 receives signals from switches 25 including the water level set switch, the cleanser concentration set switch, the start switch, and the like, water level detector 26 for detecting a water level in the rotary tub (not shown), safety switch 27 for detecting abnormal vibrations of the rotary tub during a spin-drying cycle, and waveform shaping circuit 28. As shown in FIGS. 5A and 5B, circuit 28 supplies a pulse to microcomputer 24 in each cycle of AC source voltage AC. This pulse has a pulse width corresponding to a half cycle from a zero-crossing point of the above cycle. As will be apparent from the following description, microcomputer 24 counts the number of pulses (the cycle number of the AC source voltage) output from circuit 28 from a timing at which motor 16 is driven when a cleanser is to be fed. When the count number reaches a set value, microcomputer 24 stops driving of motor 16. Therefore, microcomputer 24 serves as counting means and motor controlling means. In FIG. 4, reference numeral 29 denotes a clock generator for generating a clock signal for operating microcomputer 24; 30 and 31, drivers, controlled by microcomputer 24, for driving motor 16 and valve 19; 32, a washing machine motor for driving the rotary tub (not shown) and the agitator therein; 33, a water drainage valve; 34, a display for displaying information set by switches 25; and 35, 36, and 37, drivers, controlled by microcomputer 24, for driving motor 32, valve 33, and display 34, respectively. Note that voltage AC is selectively applied to motors 16 and 32 and valves 19 and 33.

Figure 6:
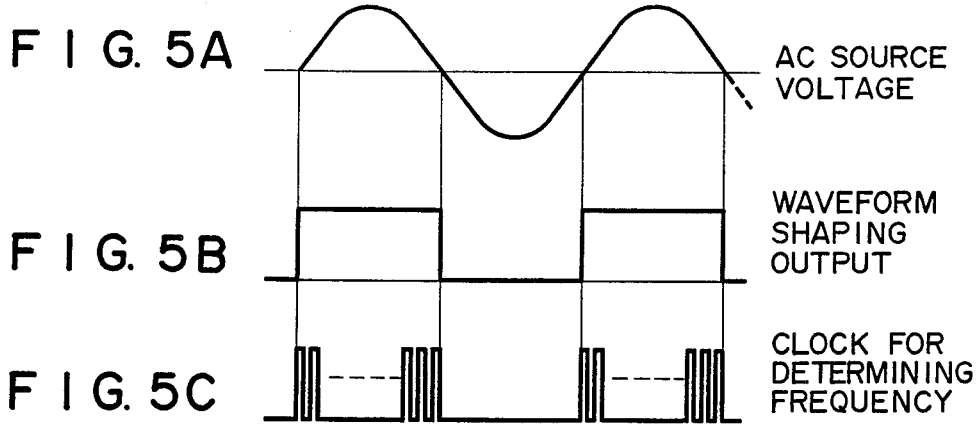

Microcomputer 24 has a program for controlling a washing operation and a spin-drying operation, and a program for controlling the feeding of cleanser, performed prior to the washing operation. In order to feed a cleanser in an amount corresponding to a water level and a cleanser concentration set by the switches, microcomputer 24 stores the driving time of motor 16 in units of frequencies of the AC source voltage in a form of a table. FIGS. 6 and 7 show the driving time of motor 16 for the respective frequencies.

Figure 8:
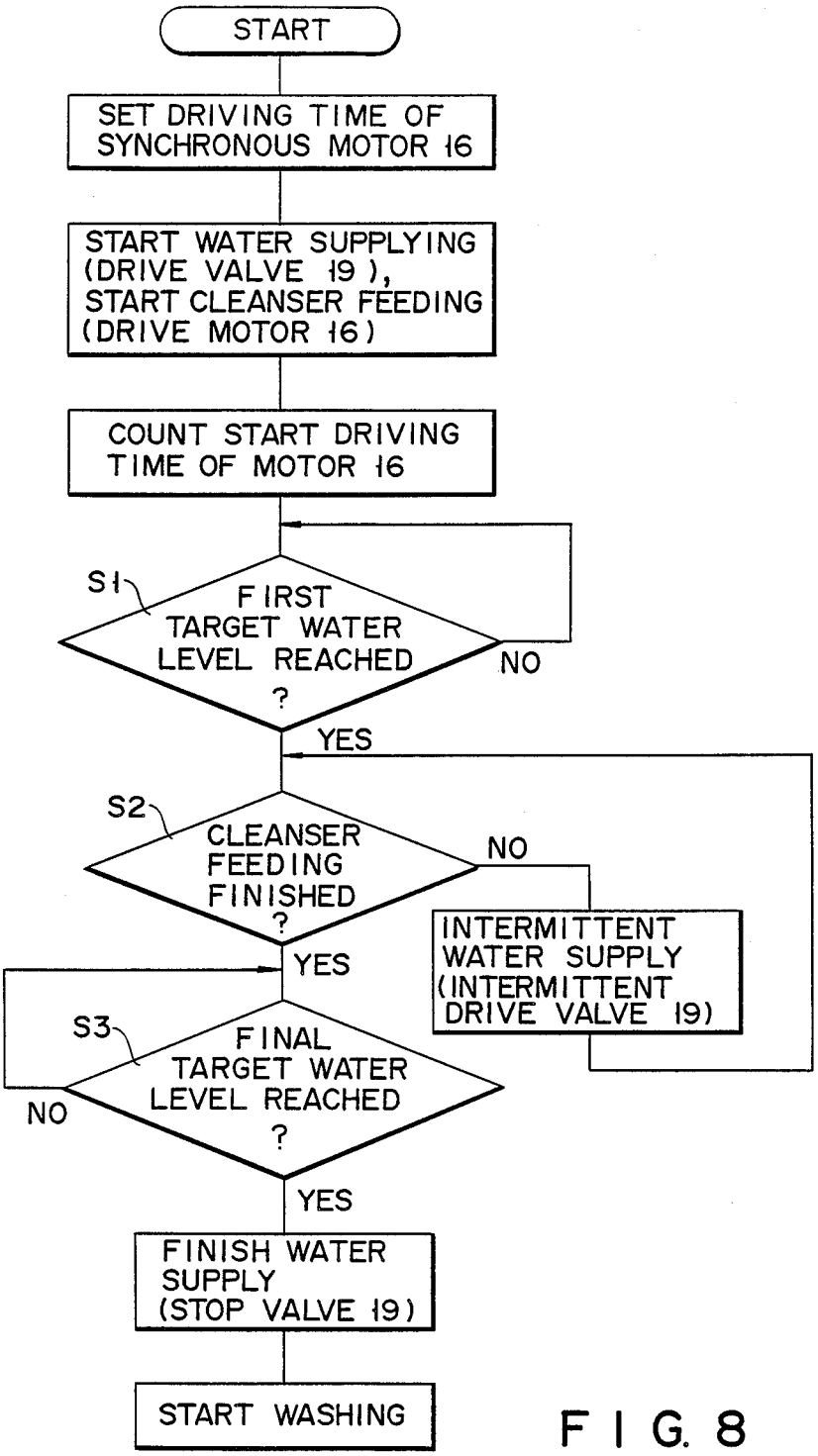

The cleanser feeding-operation performed prior to start of the washing operation in the above arrangement will be described below with reference to the flow chart shown in FIG. 8.

First, a desired water level corresponding to a weight of the items to be washed is set by operating the water levelsetting switch. Then, a desired cleanser concentration is set by operating the cleanser concentration-setting switch. Further, the start switch is operated. Then, the driving time of motor 16 is automatically set as follows.

That is, microcomputer 24 counts the number of pulses of the clock signal supplied from generator 29 within a time interval corresponding to one pulse supplied from circuit 28 as shown in FIG. 5C, i.e., a time interval corresponding to a half cycle of the AC source voltage, and determines a frequency of the AC source voltage in accordance with the count number. Then, in accordance with the frequency of the AC source voltage thus determined and the water level and the cleanser concentration set as described above, microcomputer 24 reads out a predetermined time from data stored in a form of a table as shown in FIGS. 6 and 7, and sets the readout time as the driving time of motor 16. Assume that the frequency of the AC source voltage is 60 Hz, the set water level is "medium", and the set cleanser concentration is "standard". In this case, the driving time of motor 16 is set to 54 seconds in accordance with time data shown in FIG. 6.

When the driving time of motor 16 is set as described above, water supply valve 19 is driven to start water supplying, and motor 16 is driven to start cleanser feeding. At the same time, microcomputer 24 starts counting of the pulses input thereto from circuit 28, thereby calculating a time elapsed from the start of driving of motor 16 in accordance with the counted number of the pulses. That is, in this embodiment, the number of pulses has a one-to-one correspondence with the cycle number of the AC source voltage. Therefore, when the frequency of the AC source voltage is 60 Hz and the pulse count number is 120, the elapsed time is calculated to be 2 seconds. Motor 16 is continuously driven until the elapsed driving time of motor 16, thus calculated, coincides with the set driving time. When the elapsed driving time coincides with the set driving time, or the count number of pulses from circuit 28 reaches 3,240 when the set time is 54 seconds, motor 16 is stopped.

When cleanser feeding and water supplying are started, cleanser feeding member 12 of FIG. 1 is rotated by motor 16 so that a cleanser stored in hopper 9 falls down from outlet 10*a* of cleanser feed portion 10 to cleanser receiving portion 22. At the same time, water is supplied to the rotary tub (not shown) from unit 20 through valve 19, port 21 and portion 22. Therefore, the cleanser fed in portion 22 is carried down by water into the rotary tub.

After water supplying is started, water level detection signals are normally supplied from detector 26 to microcomputer 24. In step S1 of the flow chart shown in FIG. 8, microcomputer 24 determines whether the water level in the rotary tub, detected by the water level detection signal, has reached a water level (to be referred to as a first target level hereinafter) lower than the set water level by a predetermined water level. When the water level in the rotary tub has reached the first target water level upon continuous supply of water, microcomputer 24 determines "YES" in step S1, and the flow advances to step S2. In step S2, microcomputer 24 determines whether cleanser feeding is finished, i.e., the set driving time of motor 16 has elapsed. In this case, microcomputer 24 determines whether the set driving time has elapsed by determining whether the count value of the cycle number of the AC source voltage from start of driving reaches "3,240" if the set driving time of motor 16 is 54 seconds. If cleanser feeding is finished when the flow advances to step S2, microcomputer 24 determines "YES" in step S2, and the flow directly advances to step S3. In step S3, microcomputer 24 determines whether the water level in the rotary tub reaches a final target water level. If the water level has not reached the final target water level, microcomputer 24 determines "NO" in step S3, and water is continuously supplied until the final target water level is reached. When the water level in the rotary tub has reached the final target water level, microcomputer 24 determines "YES" in step S3 and stops driving of valve 19. As a result, water supplying is stopped, and the wash operation is started.

Water remaining in a bath tub is sometimes supplied into the rotary tub prior to washing. If water supplying is started by operating the start switch while water is stored beforehand in the rotary tub as described above, the water level in the rotary tub sometimes reaches the first target water level before cleanser feeding is finished, i.e., the set driving time of motor 16 has elapsed. In this case, microcomputer 24 determines "NO" in step S2. Then, microcomputer 24 controls driving of valve 19, e.g., drives valve 19 for 2 seconds and stops driving thereof for 10 seconds. Such intermittent water supplying is continuously performed until the cleanser feeding is finished. The cleanser fed to cleanser receiving portion 22 during this intermittent supply of water is supplied along with the water into the rotary tub. Hence, the cleanser does not remain in portion 22. When cleanser feeding is finished, microcomputer 24 determines "YES" in step S2 and finishes intermittent water supplying. Then, the flow advances to step S3. In step S3, valve 19 is continuously driven until the final target water level is reached. When the final target water level is reached, valve 19 is stopped, and the washing operation is started.

As described above, according to the above embodiment, in the cleanser feeding mechanism wherein the cleanser feeding amount is determined in accordance with the number of revolutions of cleanser feeding member 12, the total number of revolutions of synchronous motor 16 as a drive source of the mechanism within a driving time is unconditionally determined in accordance with the total cycle number of the AC source voltage counted within the driving time. In this embodiment, the driving time of motor 16 is controlled by counting the number of cycles of the AC source voltage from start of driving. That is, according to FIGS. 6 and 7, if the set water level is "medium" and the set amount of cleanser is "standard", the driving time is 54 seconds for 60 Hz and is 65 seconds for 50 Hz. In this case, the cycle count number of the AC source voltage for controlling the driving time is "3,240" for 60 Hz and is "3,250" for 50 Hz. Thus, a difference between the cycle numbers is only "10". That is, the total number of revolutions of motor 16 rarely varies regardless of whether the frequency of the AC source voltage is 60 Hz or 50 Hz. Therefore, the cleanser feeding amount does not largely vary, despite a difference in the frequencies of the AC source voltages, and substantially the same amount of cleanser can be fed under the same conditions regardless of the frequency.

Figure 10:
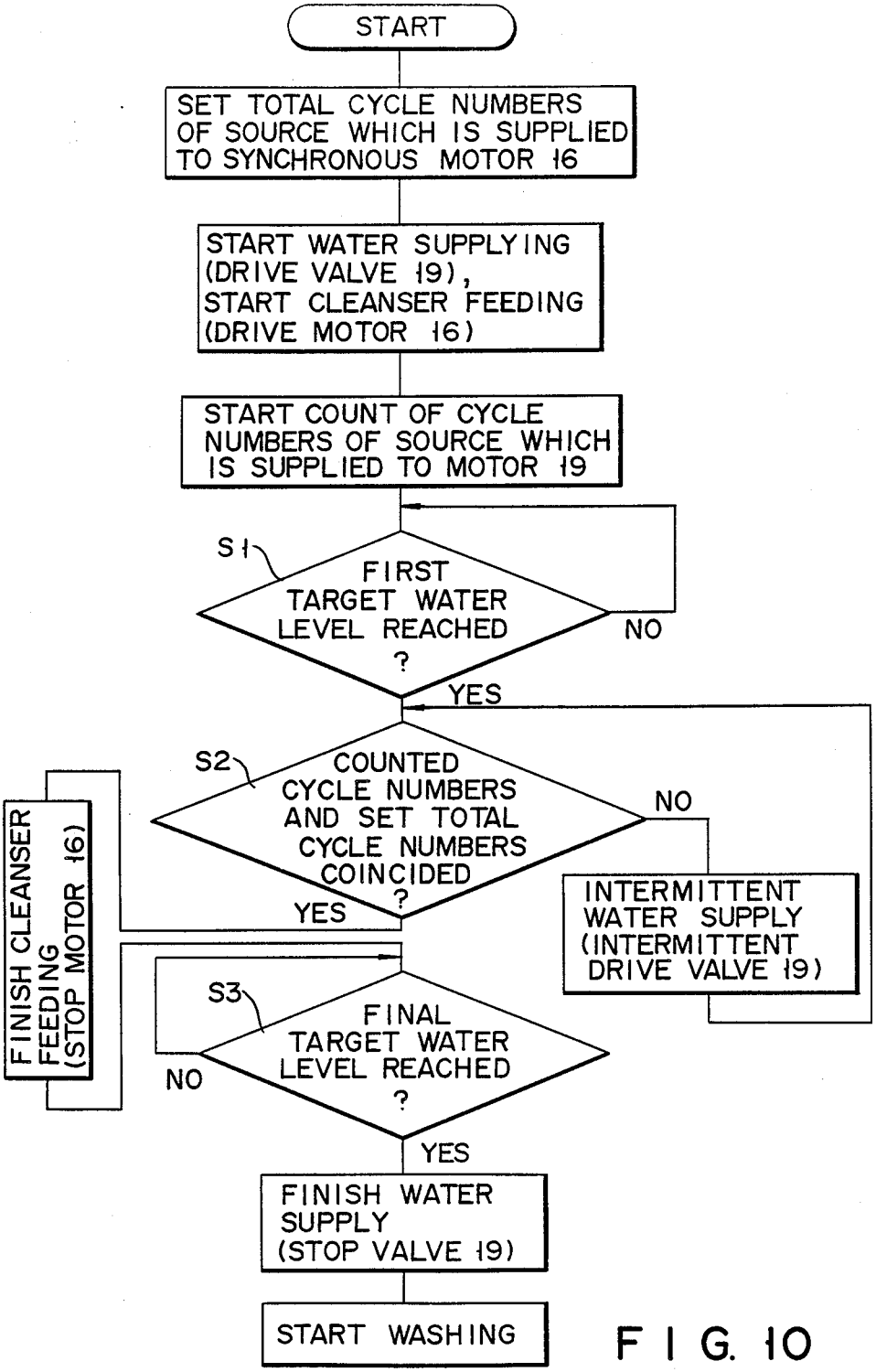

Note that in the above embodiment, microcomputer 24 stores the driving time of motor 16 in units of frequencies of the AC source voltage in the form of a table. However, as shown in FIG. 9, microcomputer 24 may store the total cycle number of the AC source voltage applied to motor 16 in the form of a table regardless of its frequency. In this case, as shown in the flow chart of FIG. 10, motor 16 is stopped when the number of pulses output from waveform shaping circuit 28 which is counted from the starting of driving of motor 16 has reached the set cycle number. According to this embodiment, since the number of cycles applied to the synchronous motor remains the same regardless of the frequency of the AC source voltage, i.e., whether the frequency is 60 Hz or 50 Hz, the cleanser feeding amount remains the same.

The present invention is not limited to the embodiment described above with reference to the accompanying drawings. For example, the cleanser feeding member may be a screw or the like as long as a cleanser feeding amount is determined by the number of revolutions of the synchronous motor. Moreover, the present invention can be applied to not only a washing machine but also to any system using a cleanser such as a dish washer. Thus, the present invention can be variously modified and carried out without departing from the spirit and scope of the invention.

As is apparent from the above description, according to the automatic detergent dispenser apparatus for a washing machine and the like, a synchronous motor driven by an AC source voltage is used as a power source, a cleanser feeding mechanism is provided to feed a cleanser in an amount corresponding to the number of revolutions of the synchronous motor, counting means is provided to count the number of cycles of the AC source voltage from a timing at which the synchronous motor is driven, a motor control means is provided to stop driving of the synchronous motor when the counting means counts a set cycle number. Therefore, even if the frequency of the AC source voltage is changed, the number of cycles of the AC source voltage applied to the synchronous motor is controlled to be substantially or completely the same. As a result, a total number of revolutions of the synchronous motor becomes substantially or completely the same regardless of the frequency of the AC source voltage, so that a large variation in a cleanser feeding amount can be effectively prevented.

What is claimed is:

1. An automatic detergent dispenser apparatus comprising:

cleanser feeding means, having a cleanser housing portion for storing a cleanser therein, a cleanser feeding member for feeding said cleanser stored in said cleanser housing portion, and a synchronous motor for driving said cleanser feeding member for feeding an amount of cleanser corresponding to a number of revolutions of said synchronous motor;

cleanser feeding amount-setting means for setting a target amount of cleanser desired to be fed from said cleanser feeding means;

driving means for selectively applying an AC source voltage from an AC power source to said synchronous motor;

frequency determining means for determining a frequency of the AC source voltage;

counting means for counting a number of cycles of the AC source voltage beginning at a time when the AC source voltage is first applied to said synchronous motor;

driving time-setting means receiving said target amount of cleanser, for setting a driving time corresponding to said target amount in units of frequencies of the AC source voltage;

reference cycle number-setting means for setting a total number of cycles of the AC source voltage which corresponds to the driving time set by said driving time setting means, in units of frequencies of the AC source voltage; and motor control means for comparing a count output from said counting means with the total cycle number from said reference cycle number-setting means which corresponds to a determination result from said frequency determining means and for controlling said driving means to stop application of the AC source voltage to said synchronous motor when the count and the total cycle number coincide with each other.

2. An apparatus according to claim 1, wherein:

said cleanser feeding member of said cleanser feeding means comprises a coil.

3. An apparatus according to claim 1, wherein:

said cleanser feeding means has a water path, and the cleanser is fed together with water from said water path.

4. An apparatus according to claim 1, wherein:

said cleanser feeding means has a cleanser agitator to be engaged with said cleanser feeding member.

5. An apparatus according to claim 1, wherein said cleanser feeding amount set means includes settings for the cleanser feeding amount of "much", "standard", and "rare".

6. An apparatus according to claim 1, wherein:

said reference cycle number set means sets the reference cycle number in accordance with a water level in a system to which the cleanser is fed.

7. An apparatus according to claim 1, wherein:

the cycle number of said AC source voltage is the number of output pulses supplied, from a waveform shaping circuit connected to the AC power source, in a positive or negative half cycle.

8. An apparatus according to claim 7, wherein: said frequency determining means comprises clock generating means for generating a dock signal with a predetermined period, counting means for counting the clock signal corresponding to the period of the output pulse, and determining means for determining the frequency in accordance with the counting result of the clock signal.

* * * * *